US007627926B2

(12) United States Patent
Williams

(10) Patent No.: US 7,627,926 B2
(45) Date of Patent: Dec. 8, 2009

(54) CLEANING APPARATUS

(75) Inventor: Steve Williams, Hayden Lake, ID (US)

(73) Assignee: U.S. Products, Coeur d'Alene, ID (US)

( * ) Notice: Subject to any disclaimer, the term of this patent is extended or adjusted under 35 U.S.C. 154(b) by 801 days.

(21) Appl. No.: 11/130,473

(22) Filed: May 17, 2005

(65) Prior Publication Data

US 2006/0275146 A1 Dec. 7, 2006

(51) Int. Cl.
*A47L 7/00* (2006.01)

(52) U.S. Cl. ..... 15/320; 15/321; 15/327.1; 239/128; 239/135

(58) Field of Classification Search ..... 15/320, 15/321, 327.1; 239/128, 135, 722, 754; 413/234
See application file for complete search history.

(56) References Cited

U.S. PATENT DOCUMENTS 3,831,223 A * 8/1974 Colt et al. ..... 15/321
4,826,539 A * 5/1989 Harpold ..... 134/10

* cited by examiner

*Primary Examiner*—Shay L Karls
(74) *Attorney, Agent, or Firm*—Wells St. John P.S.

(57) ABSTRACT

A cleaning apparatus is described and which includes a housing which is moveable across a supporting surface; a first electrically actuated fluid pump which is mounted in the housing, and which is operable to deliver a first stream of fluid at a pressure of at least about 150 PSI to less than about 1200 PSI; a second electrically actuated fluid pump which is mounted in the housing, and which is operable to deliver a second stream of fluid, at a pressure, of less than about 150 PSI; and an electrically actuated heater which is mounted in the housing, and which is operable to impart heat energy to the second fluid stream.

33 Claims, 7 Drawing Sheets

CLEANING APPARATUS

TECHNICAL FIELD

The present invention relates to a cleaning apparatus, and more specifically to a cleaning apparatus which produces a first fluid stream having a pressure of about 150 PSI to about 1,200 PSI, and a second fluid stream which has a pressure of less than about 150 PSI, and wherein the first and second fluid streams are delivered to a surface to be cleaned.

BACKGROUND OF THE INVENTION

The prior art is replete with numerous examples of various floor cleaning apparatuses of various designs and which are utilized to clean either hard flooring surfaces, or various forms of carpeting, but not both.

As a general matter, most of these devices have very similar design features. These include, among others, a fluid dispensing tank which typically holds a source of fluid, and chemical to be dispensed on the flooring surface to be cleaned, a pump which removes the fluid from the fluid dispensing tank, and which delivers it to an applicator, and an electrically actuated vacuum pump which is operable to create a vacuum at the applicator end, and which is operable to remove the previously applied fluid from the dispensing tank, and deliver it back into a fluid recovery tank. Once the fluid is dispensed completely from the fluid dispensing tank, the fluid recovery tank is typically removed from the cleaning device, and then disposed of by dumping the contents of same into a suitable drain.

It is well known by those skilled in the art that the amount of floor covering that can be effectively cleaned by devices such as this is quite limited, and is typically constrained by the volume of the fluid dispensing tank. Moreover, the usefulness of these devices is sometimes limited inasmuch as that these devices are often used in areas where there is not a convenient source of hot water for refilling the fluid dispensing tank. Further, it is well known that the time necessary to fill the dispensing tank as well as dispose of the contents of the fluid recovery tank may be significant. Further, the typical prior art fluid pressure, which is provided to applicator devices employed with these devices is typically, relatively low. These prior art fluid pressures are, as a general matter, not useful for cleaning hard surfaces such as tile, and the like that may have ground in dirt, and other debris, which is often difficult to remove at these low fluid pressures.

Therefore, a cleaning apparatus which addresses the various shortcomings attendant with the prior art cleaning devices which have been utilized heretofore is the subject matter of the present application.

SUMMARY OF THE INVENTION

A first aspect of the present invention relates to a cleaning apparatus, and which includes a housing which is moveable across a supporting surface; a first electrically actuated fluid pump which is mounted in the housing, and which is operable to deliver a first stream of fluid at a pressure of at least about 150 PSI to less than about 1200 PSI; a second electrically actuated fluid pump which is mounted in the housing, and which is operable to deliver a second stream of fluid, at a pressure, of less than about 150 PSI; and an electrically actuated heater which is mounted in the housing, and which is operable to impart heat energy to the second fluid stream.

Another aspect of the present invention relates to a cleaning apparatus which includes a moveable base portion having an upwardly facing, and a downwardly facing surface; a first electrically actuated fluid pump which consumes less than about 15 AMPS of electrical power, and which, when energized, is operable to deliver a first fluid stream at a pressure of at least 150 PSI to about 1200 PSI, and wherein the first electrically actuated pump is mounted on the upwardly facing surface of the base portion; a second electrically actuated fluid pump which consumes a given amount of electrical power, and which, when energized, is operable to deliver a second fluid stream at a pressure of less than about 150 PSI, and wherein the second electrically actuated fluid pump is mounted on the upwardly facing surface of the base portion; an electrically actuated heater mounted on the upwardly facing surface of the base portion, and which is coupled in fluid flowing relation relative to the second electrically actuated fluid pump, and wherein the electrically actuated heater consumes a given amount of electrical power, and wherein the electrical power consumed by the electrically actuated heater is less than about 15 AMPS; an electrically actuated vacuum pump mounted on the upwardly facing surface of the base portion; a first source of AC electrical power and which is alternatively electrically coupled to the first electrically actuated fluid pump, and the electrically actuated heater; a second source of AC electrical power and which is electrically coupled to the second electrically actuated fluid pump and the vacuum pump; and a fluid dispensing tank positioned in spaced relation relative to the base portion, and which is further coupled in fluid flowing relation relative to each of the first and second electrically actuated fluid pumps, and the heater.

Still another aspect of the present invention relates to a cleaning apparatus which includes a base portion which is moveably supported in spaced relation relative to an underlying floor by a plurality of wheels, and wherein the base portion has a first and second end, and an upwardly facing surface; an upper housing portion having a main body which is hingedly mounted to the first end of the base portion, and wherein the upper housing portion matingly couples with and rests in covering relation relative to the upwardly facing surface of the base portion, and wherein the upper housing portion defines an internal cavity; a fluid dispensing tank which forms a portion of the upper housing portion, and which is further disposed in spaced relation relative to the upwardly facing surface of the base portion; a fluid recovery tank which forms a portion of the upper housing portion, and which is positioned in spaced relation relative to the upwardly facing surface of the base portion, and is juxtaposed relative to the fluid dispensing tank; a hose reel which is rotatably supported on the fluid dispensing tank; an electrically actuated dumping pump mounted on the first end of the base portion, and which is coupled in fluid flowing relation relative to the fluid recovery tank, and wherein the dumping pump is operable, when energized, to remove fluid from the fluid recovery tank and expel it to the ambient environment; an electrically actuated vacuum pump borne by the upwardly facing surface of the base portion, and received in the cavity which is defined by the upper housing portion, and wherein the electrically actuated vacuum pump is further coupled in fluid flowing relation relative to the fluid recovery tank, and wherein the electrically actuated vacuum pump, when energized, is operable to remove fluid which is present on the floor, and deliver it into the fluid recovery tank; a first electrically actuated fluid pump which is borne by the upwardly facing surface of the base portion, and which is coupled in fluid flowing relation relative to the fluid dispensing tank, and wherein the first electrically actuated fluid pump, when energized, removes a source of fluid from the fluid dispensing tank and creates a first stream of fluid which is delivered to the floor at a pressure of at least about 150 PSI to less than about 1200 PSI; a first power cord which is electrically coupled to the first electrically actuated fluid pump and which is operable to deliver a first source of electrical power to the first electrically actuated fluid pump, and wherein the first electrically actuated fluid pump consumes less than about 15 Amps of electricity from the first source of electrical power; a second electrically actuated fluid pump which is borne by the upwardly facing surface of the base portion, and which is coupled in fluid flowing relation relative to the fluid dispensing tank, and wherein the second electrically actuated fluid pump, when energized, removes the source of fluid from the fluid dispensing tank, and further creates a second stream of fluid which is delivered to the floor at a pressure of less than about 150 PSI; an electrically actuated heater which is operable to impart heat energy to the second fluid stream, and which is mounted on the upwardly facing surface of the base portion, and which is further energized by way of the first power cord, and wherein the heater consumes less than about 15 Amps of electrical power from the first source of electrical power, and wherein the first electrically actuated fluid pump and the electrically actuated heater are alternatively energized; and a second power cord which is electrically coupled to the second electrically actuated fluid pump, dumping pump; and vacuum pump, and wherein the electrical power consumed by the second electrically actuated fluid pump, dumping pump and vacuum pump, in combination, is less than about 15 Amps.

These and other aspects of the present invention will be discussed in greater detail hereinafter.

BRIEF DESCRIPTION OF THE DRAWINGS

Preferred embodiments of the invention are described below with reference to the following accompanying drawings.

FIG. 5 is a partial, plan view of a control panel utilized with the present invention, and which is taken along line 5-5 of FIG. 3.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
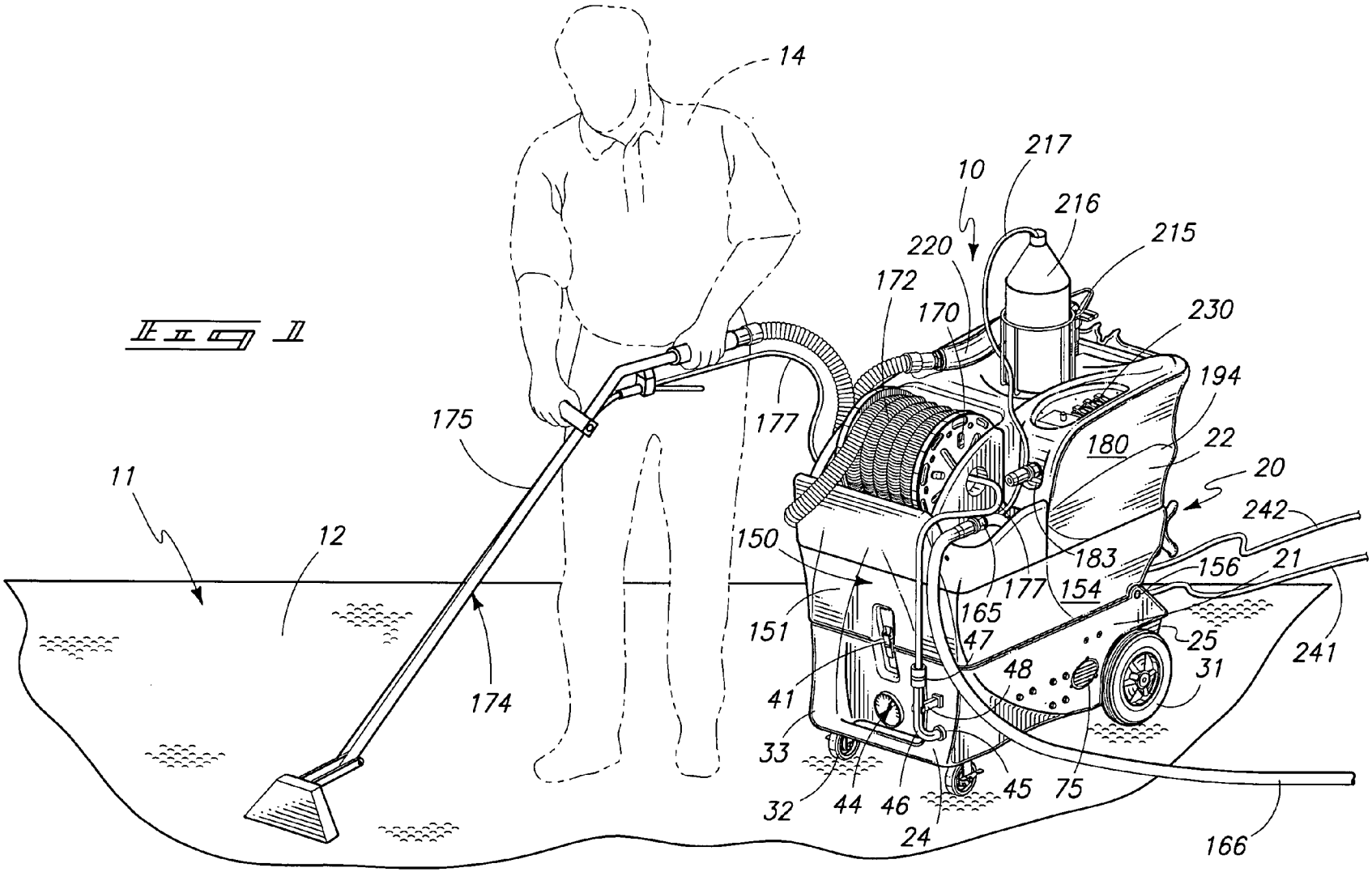
FIG. 1 is a perspective, environmental view of the present invention being utilized to clean a carpeted flooring surface.
Figure 2:
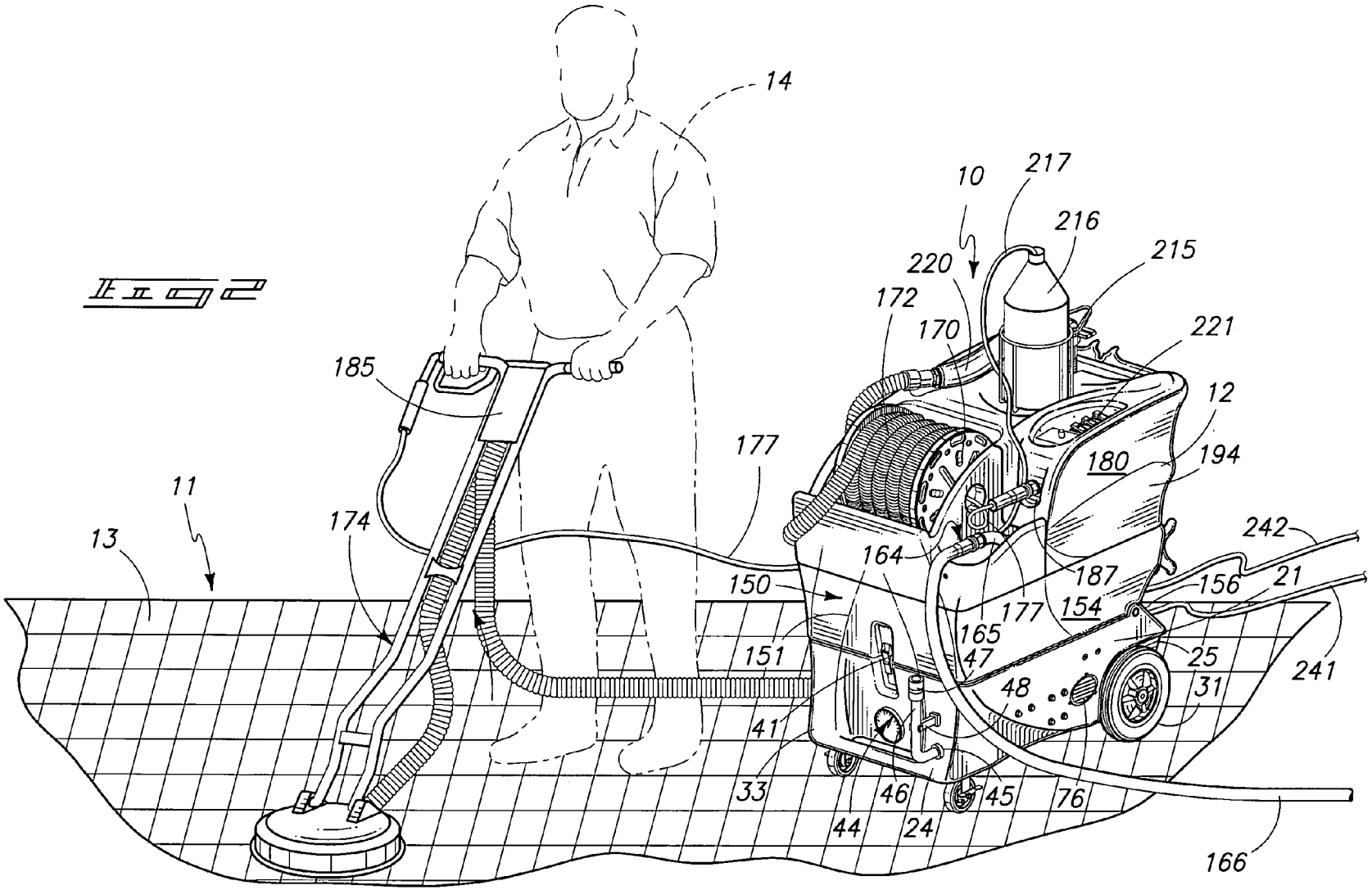
FIG. 2 is a perspective, environmental view of the present invention being utilized to clean a grouted tile surface.

Referring more particularly to the drawings, the cleaning apparatus of the present invention is generally indicated by the numeral 10 in FIG. 1 and following. As shown in FIGS. 1 and 2 for example, the present invention provides a multitude of advantages over the previous prior art devices and products which have been utilized heretofore. In particular, the present invention is useful in cleaning various flooring surfaces 11 which include carpet 12, and grouted tile 13, as well has other hard surfaces which may be fabricated from natural or synthetic substances. As seen by reference to FIGS. 1 and 2, the present invention is moveable across a supporting surface such as a flooring surface 11, and can be positioned in various locations so that it may be used effectively by the operator 14. As will be seen, the invention 10 provides many advantages inasmuch as the present device can be employed to clean a variety of different flooring surfaces in a manner not possible heretofore.

Figure 3:
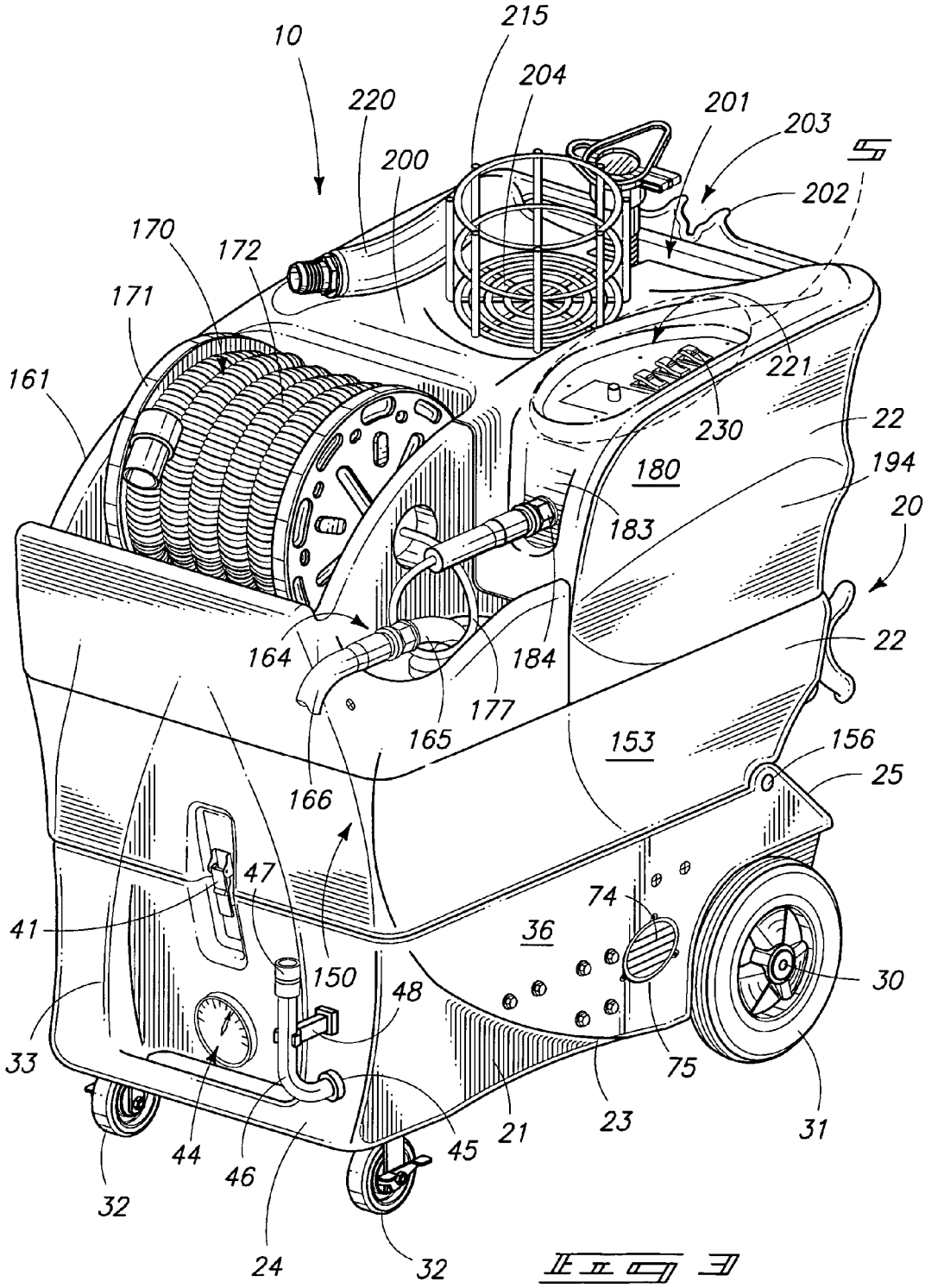
FIG. 3 is a perspective, front elevation view of the present invention.
Figure 4:
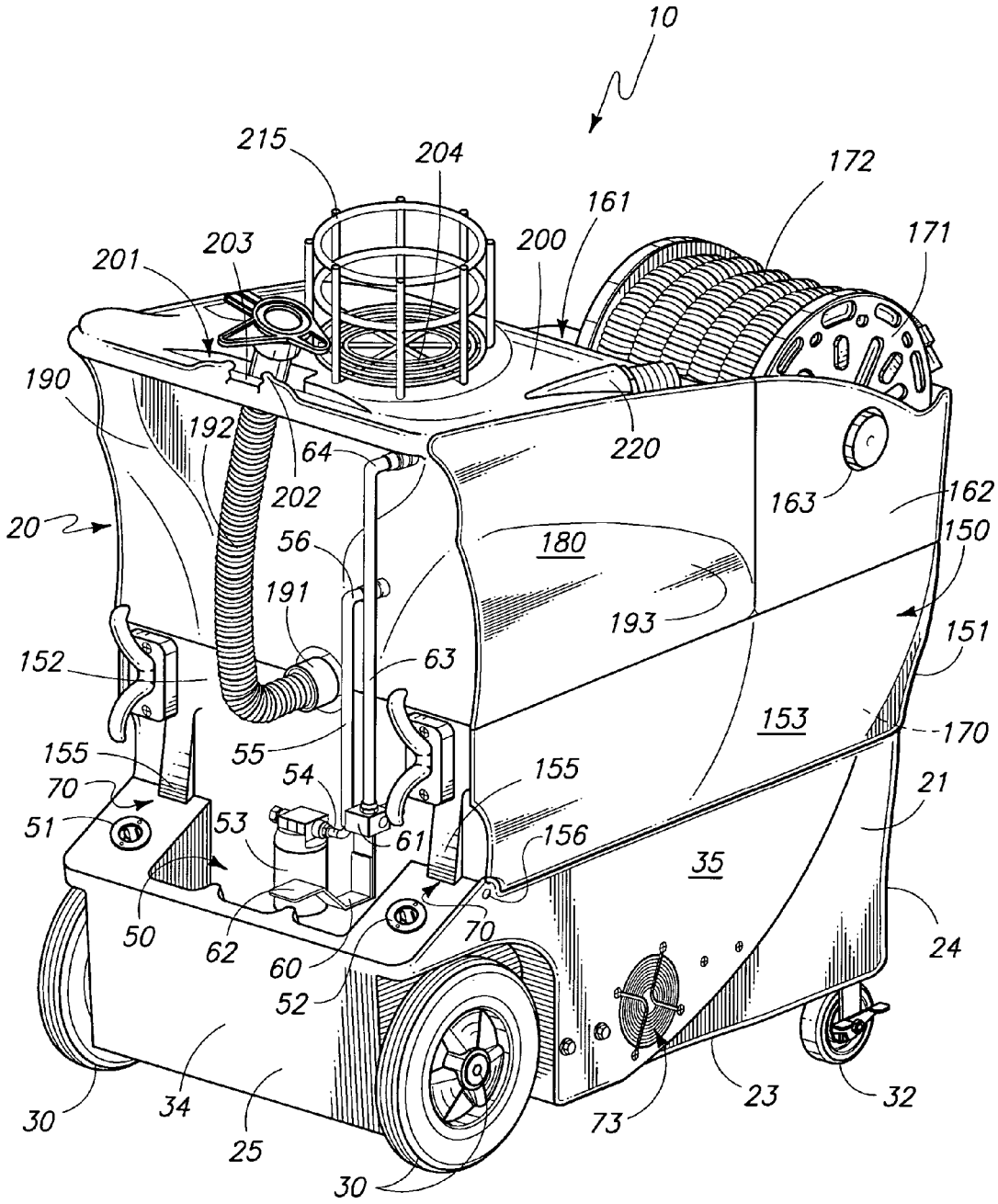
FIG. 4 is a perspective, rear elevation view of the present invention.
Figure 11:
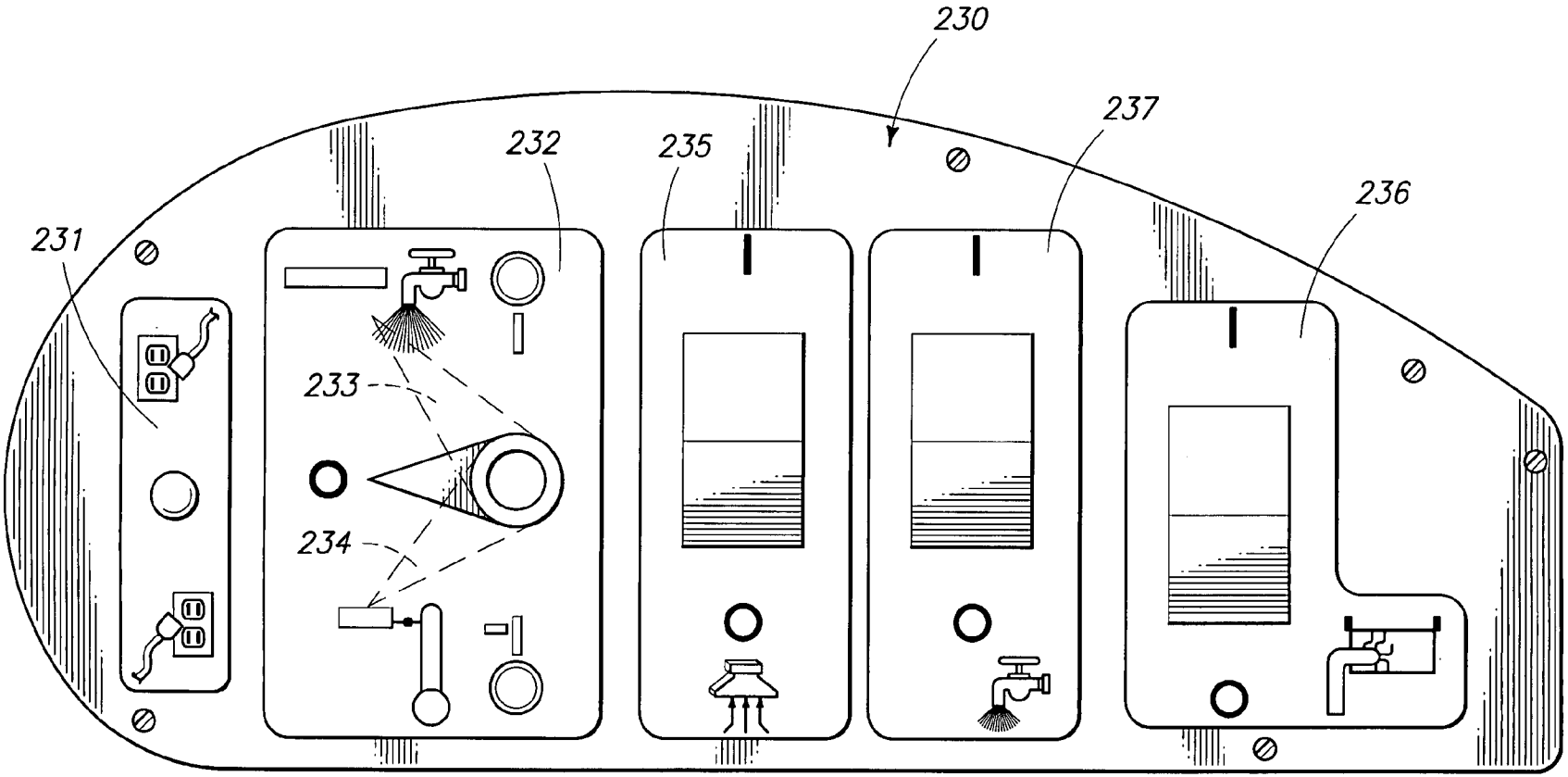
Figures 6, 6A:
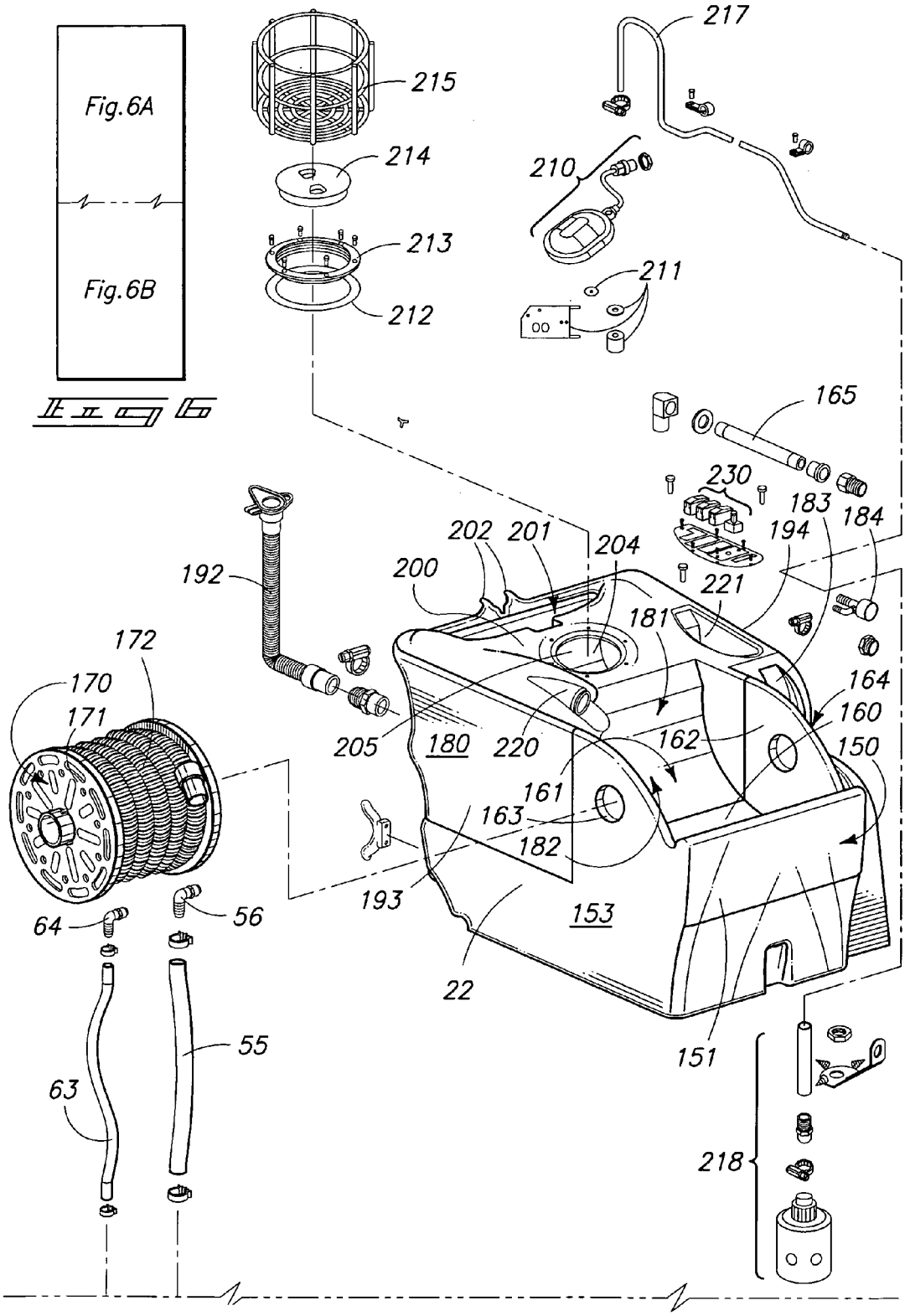
FIG. 6A is a fragmentary, perspective, exploded side elevation view of a portion of the present invention.
Figure 6B:
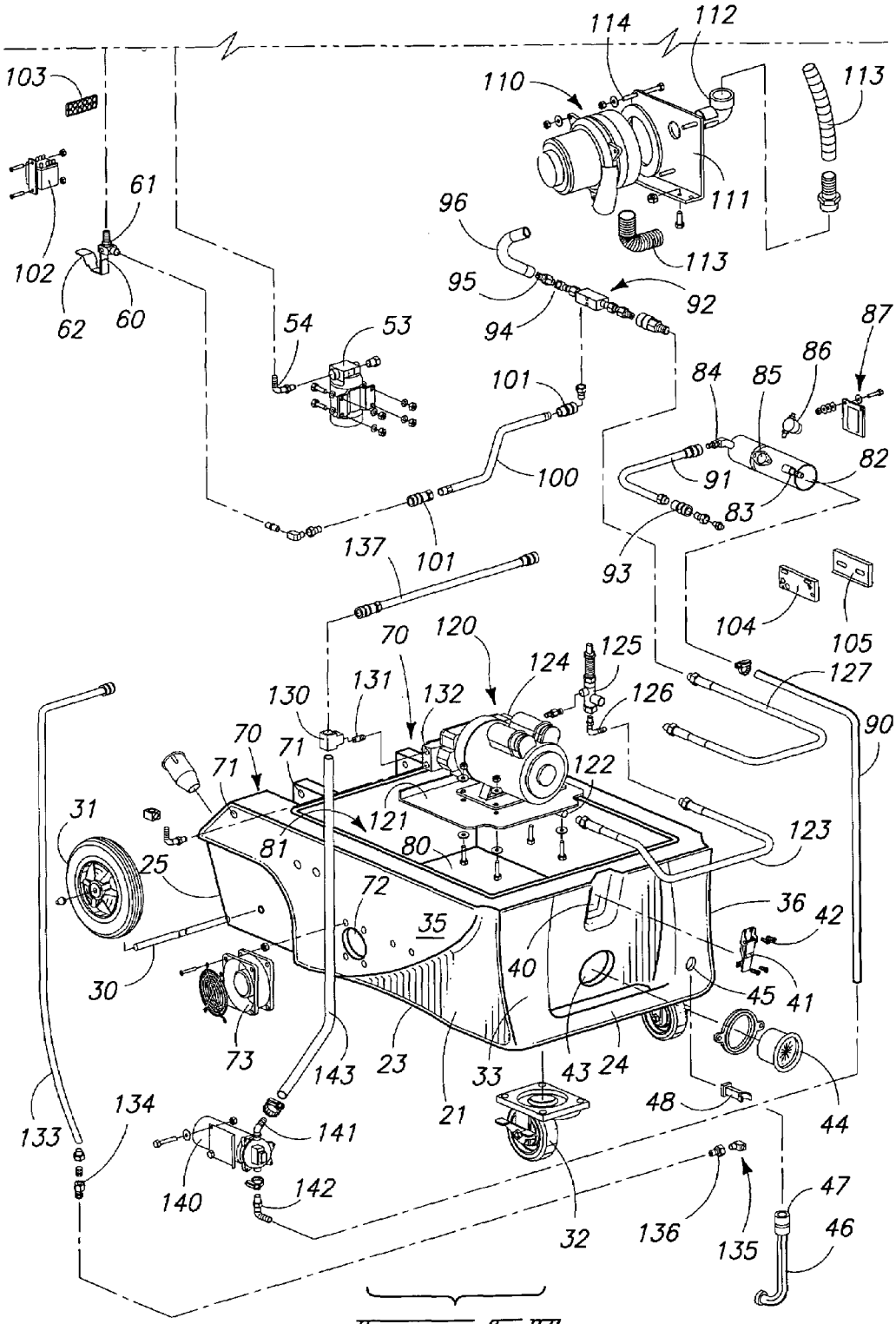
FIG. 6B is a fragmentary, perspective, side elevation view of a second portion of the present invention.

Referring now to FIGS. 3, 4 and 6B, it will be seen that the invention 10 includes a housing which is generally indicated by the numeral 20 and which includes a first base portion 21 which is operable to move across the flooring surface 11, and a second, upper, housing portion 22 which is hingedly mounted thereto. The second or upper housing portion 22 will be discussed in greater detail hereinafter. The first moveable base portion 21 is defined by a bottom surface 23 which has a first forward end 24 and an opposite, second, rearward end 25. Mounted in spaced relation relative to the second end 25 is a rotatable axel 30 which is received through the bottom surface 23 and which mounts a pair of surface engaging wheels 31 thereon. Still further, the bottom surface 23 is disposed in spaced relation relative to the flooring surface by a pair of rotatable and selectively lockable casters 32 which are mounted adjacent to the first end 24. Extending generally upwardly relative to the bottom surface 23 is a first end wall 33 and which extends upwardly relative to the first end 24 thereof; and a second end wall 34, which extends generally upwardly relative to the second end 25. Still further, first and second sidewalls 35 and 36 are provided, and which extend upwardly from the bottom surface 23, and which are joined to, or made integral with the first and second end walls 33 and 34, respectively.

As seen most clearly by reference to FIG. 6B, the first end wall 33 defines a cavity 40, and which is operable to receive a latch 41 therein by a plurality of fasteners 42 as shown. Still further, a first aperture 43 is formed substantially centrally relative to the first end wall 33. A fluid pressure gauge 44 which displays in pounds per square inch the fluid pressure, as provided by the invention 10, is positioned in substantially occluding relation relative to the aperture 43. The operation of this feature of the invention 10 will be discussed in greater detail hereinafter. Yet further, a second aperture 45 is formed in the first end wall 33. Extending outwardly relative to this aperture is a flexible fluid conduit 46. The conduit 46 terminates with a male fluid coupler 47. A hose or conduit clip 48 is affixed to first end wall 33 and is operable to secure the conduit 46 when it is not in use.

Referring now to FIG. 4, it will be seen that the second end wall 34 defines an upwardly facing cavity 50. Still further, and as seen in FIG. 4, the second end wall is operable to mount first and second power cord receptacles indicated by the numerals 51 and 52. These power cord receptacles are operable to interface with first and second power cords, which will be described below, and which couples the present invention 10 with two sources of alternating current (AC) power. As seen in FIG. 4, a dumping pump 53 is mounted on the second end wall, and is positioned in the cavity 50. The dumping pump is connected in fluid flowing relation relative to a first elbow 54 (FIG. 6B). A conduit 55 is coupled in fluid flowing relation relative to the first elbow 54 and further, a second elbow 56 couples the conduit in fluid flowing relation relative to a fluid recovery tank which will be discussed in greater detail hereinafter. As seen in FIG. 4, the present invention 10 includes a foot operated priming valve 60 which is positioned, at least in part, within the upwardly facing cavity 50. The foot operated priming valve has valve body 61 which is mounted on the second end wall 34 and further, a foot engagement portion 62 is mounted on the valve body 61, and extends outwardly relative thereto such that it may be engaged by the foot of the operator 14. The priming valve operates to facilitate the priming of one of the electrically actuated pump assemblies which will be discussed in greater detail hereinafter. The valve body 61 is coupled in fluid flowing relation relative to a conduit 63. Still further, an elbow 64 is connected to the conduit 63, and is operable to couple the valve body in fluid flowing relation relative to a fluid dispensing tank which will be discussed in greater detail hereinafter. As seen in FIG. 4, the second end wall 34 defines two pairs of spaced engagement members 70. Coaxially aligned channels or passageways 71 are provided in each of the pair of spaced engagement members. The pair of spaced engagement members defines a pivot point for the second upper housing portion 22 which will be described in greater detail hereinafter. As seen in the drawings, an aperture 72 is formed in the first sidewall 35. Further, a fan assembly 73 is positioned in partial occluding relation relative to the aperture 72 and is operable to draw air through the cavity which will be discussed below, and which is defined by the base portion 21. Still further, another aperture 74 is formed in the second sidewall 36. Further, a vent cover 75 is positioned in substantially occluding relation relative to that aperture and allows air from the ambient environment to pass therethrough.

Referring now to the exploded, fragmentary, perspective view of FIG. 6B it will be seen that the first movable base portion 21 includes an upwardly facing supporting surface 80 which is mounted or otherwise positioned adjacent to the first and second end walls 33 and 34, and the first and second sidewalls 35 and 36, respectively. A cavity 81 is defined between the several end walls, and sidewalls, and is operable to receive, among other assemblies, an electrically actuated heater and associated heat exchanger which is generally indicated by the numeral 82. The electrically actuated heater has a fluid inlet 83, a fluid outlet 84, and further a thermostat 85 is made integral therewith. Still further, the thermostat is electrically coupled with a thermostatic switch 86. The electrically actuated heater 82 is mounted in the cavity 81 by means of a mounting bracket which is shown the by the numeral 87.

As seen in FIG. 6B, a hose or conduit 90 is provided and which is coupled in fluid flowing relation relative to the fluid inlet 83 of the electrically actuated heater 82. Further, a second hose or conduit 91 is connected to the fluid outlet 84 of the same heater. This second conduit is coupled in fluid flowing relation relative to the conduit 46. Additionally, a fluid direction manifold is provided, and which is generally indicated by the numeral 92. As seen in the FIG. 6B, a quick disconnect 93 is provided, and which couples the conduit 91 in fluid flowing relation relative to the conduit 46. Still further, an elbow 94 is provided and which is coupled in fluid flowing relation relative to the fluid direction manifold 92. A male quick disconnect 95 is coupled in fluid flowing relation relative thereto, and is operable to be positioned in fluid flowing relation relative to an outlet conduit 96. In addition to the foregoing, a fluid conduit 100 is provided, and which is coupled in fluid flowing relation relative to the valve body 61 of the foot operated priming valve 60. The conduit 100 has a quick disconnect female portion 101 which couples the conduit 100 in fluid flowing relation relative to the fluid direction manifold 92. Further contained within the cavity 81 is an electrical relay which is generally indicated by the numeral 102, and a terminal block 103 which is electrically coupled thereto. The electrical relay and terminal block are electrically coupled with the various electrical components as will be identified hereinafter. Still further, a dual electrical cord sensor 104 is provided, and which is electrically coupled to the electrical relay and the terminal block. The dual electrical cord sensor 104 is operable to sense when there are two sources of AC power which are electrically coupled to the invention 10. A mounting bracket 105 is provided and which releasably mounts the dual electrical cord sensor 104 in an appropriate location within the cavity 81 as described above.

Still referring to FIG. 6B, it will be seen that an electrically actuated vacuum pump 110 is borne by the upwardly facing surface 80 of the moveable base portion 21. The electrically actuated vacuum pump is mounted on the upwardly facing surface by a vacuum pump manifold 111. An elbow 112 is coupled in fluid flowing relation relative to the electrically actuated vacuum pump 110. Further, a pair of vacuum hoses 113 are coupled in fluid flowing relation relative to the elbow and the vacuum pump. Still further, fasteners of conventional design 114 are operable to secure the electrically actuated vacuum pump to the vacuum pump manifold 111. As will be described in greater detail hereinafter, the electrically actuated vacuum pump 110, when energized, is operable to remove fluid which is present on the floor 11, and deliver the fluid into a fluid recovery tank which will be discussed in greater detail hereinafter.

As seen in FIG. 6B, and mounted on the upwardly facing surface 80 of the moveable base portion 21 is a first electrically actuated fluid pump 120 which is operable to deliver a first stream of fluid, at a pressure of at least about 150 PSI to about 1,200 PSI to a flooring surface 11 as will be described hereinafter. The first electrically actuated pump 120, when energized, consumes less than about 15 Amps of electrical power, and will be energized through a first source of AC electrical power which is alternatively electrically coupled to the first electrically actuated fluid pump and the electrically actuated heater 82 as will be described in greater detail below. The first electrically actuated pump 120 which produces a first fluid stream is useful in cleaning hard surfaces such as grouted tile 13 as seen in FIG. 2. In view of the amount of electrical energy consumed by the first electrically actuated pump, the present invention 10 operates in a fashion whereby either the electrically actuated heater 82, or the first electrically actuated fluid pump 120 are energized, but not together, inasmuch as if both subassemblies were energized in unison, they would collectively consume more than about 15 Amps of electrical power. This would typically overwhelm most residential and commercial electrical circuits. The first electrically actuated fluid pump 120 is mounted on the upwardly facing surface 80 by a mounting plate 121 using conventional fasteners. The pump 120 has a fluid bypass outlet 122 which is coupled in fluid flowing relation to a fluid bypass conduit 123. The electrically actuated fluid pump 120 has a primary fluid pressure outlet 124 which is coupled in fluid flowing relation relative to a pressure regulating valve 125 of conventional design. An elbow 126 is coupled in fluid flowing relation relative to a pressure regulating valve 125. Further, the fluid bypass conduit 123 is coupled in fluid flowing relation relative to the elbow 126. Further, a high pressure fluid conduit 127 is provided and which is coupled in fluid flowing relation relative to the fluid direction manifold 92 and with the pressure regulating valve 125. As seen in FIG. 6B, a T-shaped fluid coupling 130 is threadably mated in fluid flowing relation relative to a conventional threaded nipple 131. The threaded nipple, in turn, is coupled in fluid flowing relation relative to a secondary fluid pressure outlet 132. A conduit 133 is provided, and is coupled in fluid flowing relation relative to the secondary high pressure fluid outlet 123. The conduit 133 has a distal end which has a quick disconnect female portion 134 provided thereon. As seen in the drawing, a fluid elbow 135 is provided and which is coupled in fluid flowing relation relative to the pressure gauge 44. Further, a quick disconnect male portion 136 is coupled in fluid flowing relation relative to the fluid elbow 135, and which couples the pressure gauge in fluid flowing relation relative to the conduit 133. By means of the conduit 133, and the T-shaped fluid coupling 130, the fluid pressure provided by the first electrically actuated fluid pump 120 can be accurately displayed by means of the fluid pressure gauge 44. A fluid delivery conduit 137 is provided. and which couples the T-shaped fluid coupling with a source of fluid to be dispensed, and which will be discussed hereinafter. By means of the fluid delivery conduit 137, fluid is delivered to both the first electrically actuated pump 120 and the second electrically activated pump 140.

A second electrically actuated fluid pump 140 is provided, and is best seen in FIG. 6B. The second fluid pump 140 is mounted on the upwardly facing surface 80 of the moveable base portion 21. The second fluid pump is operable to deliver a second stream of fluid, as will be described below, at a pressure of less than about 150 PSI to the flooring surface 11 which typically is a carpeted floor 12. The second fluid pump is typically a conventional diaphragm pump as illustrated. As seen in the drawing, first and second fluid elbows 141 and 142 are coupled in fluid flowing relation relative to the second fluid pump 140. The second elbow 142 is coupled in fluid flowing relation relative to the hose or conduit 90. This couples the second fluid pump 140 in fluid flowing relation relative to the electrically actuated heater 82. Still further, the first fluid elbow 141 is coupled to the conduit 143, and which itself is coupled in fluid flowing relation relative to the T-shaped fluid coupling 130. In the arrangement as seen, the fluid provided to the second electrically actuated diaphragm pump 140 passes through the fluid coupling 130 and is supplied from conduit 137. In the arrangement as shown, the second electrically actuated pump 140 and the heater 82, if energized together, collectively consume more than about 15 Amps of electrical power. Consequently, because of the amount of power which could be consumed, the present invention is arranged so that the electrically actuated heater 82, or the first electrically actuated pump 120 are alternatively energized by means of a first source of electrical power and a first power cord as will be described below; and the second electrically actuated pump 140 is energized by a second source of electrical power, and a second power cord, as will be described below. In the arrangement as seen, and if energized in unison, the invention 10 is operable to provide a source of heated fluid by means of the electrically actuated heater 82 to the second electrically actuated fluid pump 140 such that the heated fluid can be dispensed directly onto a carpeted surface 12 as seen in FIG. 1. As should be understood, and in the arrangement as shown, the second electrically actuated fluid pump 140 may also be energized so as to merely supply a second fluid stream which is unheated.

As seen in FIG. 1 and following, the cleaning apparatus 10 of the present invention includes a fluid dispensing tank 150 and which is hingedly mounted to the moveable base portion 21, as will be described below. The fluid dispensing tank encloses a source of fluid which is typically water mixed with a source of cleaning chemical which will be described hereinafter, and which is withdrawn from the fluid dispensing tank by the respective first and second electrically actuated pumps 120 and 140, respectively and which forms the first and second streams of fluid which are applied to the different flooring surfaces 12 and 13, respectively. The fluid is withdrawn by way of fluid delivery or supply conduit 137. For example, and as described above, the first fluid stream which is formed from the first electrically actuated pump 120 is operable to clean hard flooring surfaces such as 13, as seen in FIG. 2, and which may comprise grouted tile and the like. The first fluid stream, as earlier described, is delivered at a pressure of at least about 150 PSI to about 1,200 PSI pressure. Still further, the second fluid stream, which is provided by the second electrically actuated fluid pump 140 provides a second stream of fluid which is delivered at a fluid pressure of less than about 150 pounds per square inch. This is typically provided to carpeted flooring 12. This second fluid stream may be heated or unheated. Depending upon the circumstances, the fluid withdrawn from the fluid dispensing tank 150 is heated by means of electrically actuated heater 82. The fluid dispensing tank has a first or forward facing surface 151, and a second, opposite, or rearward facing surface 152. Further, the second fluid dispensing tank has a first sidewall 153, and a second sidewall 154. The fluid dispensing tank has a top surface (not seen), and which is coupled to the respective forward and rearward facing sidewalls of the first and second sidewalls to provide a substantially enclosed cavity for receiving and transporting the source of fluid, which is typically water or a mixture of water and a cleaning chemical solution. As seen most clearly by reference to FIG. 4, the second, or rearward facing surface 152 includes a pair of spaced hinge members 155 which are operable to be matingly and movably received between the individual pairs of spaced engagement members 70. A pin 156 is received therethrough. This permits the fluid dispensing tank 150 to be pivotally or rotatably moved out of engagement with the moveable base portion 21 and further provides access to the various components within the cavity 81, as described earlier.

As noted above, the fluid dispensing tank 150 has a top surface 160, only a portion of which is shown. The top surface 160 defines, in part, a first semi-circular cavity 161 which is operable to receive a hose reel, as will be described below. Still further, the upwardly facing cavity 161 is defined, in part, by a pair of substantially vertically extending sidewalls 162 which extend outwardly therefrom. Coaxially aligned apertures 163 are formed in the respective sidewalls 162. Further, and as seen most clearly by reference to FIG. 3, a second upwardly facing cavity 164 is defined by a portion of the top surface 160. A fluid coupler 165 is positioned within that second upwardly facing cavity and permits an exterior source of pressurized water (which may be heated or unheated) to be coupled in fluid flowing relation relative to the fluid dispensing tank 150, by means of a conduit 166. As seen most clearly by reference to FIG. 4, the fluid dispensing tank 150 defines, in part, an internal cavity into which the various components such as the first and second electrically actuated fluid pumps 120 and 140, heater 82 and electrically actuated vacuum pump 110 are received. As earlier discussed, the upwardly facing cavity 161 is operable to receive a hose reel 171 which has a section of hose 172 attached thereto. The hose 172 is utilized with a conventional applicator which is generally indicated by the numeral 174. As seen in FIG. 1, the applicator is a conventional carpet cleaning assembly 175. The fluid delivered under pressure from the second electrically actuated fluid pump 140 is delivered to the carpet cleaning assembly by way of conduit 46, and which is coupled in fluid flowing relation relative to fluid conduit 177. Conduit 177 releasably couples with the male coupler 47 which is located on the distal end of conduit 46. In the arrangement as seen in FIG. 1, conduit 177 delivers the second fluid stream to the cleaning assembly 175. Hose 172 is operable to receive fluid which has been previously deposited on the floor 11 and deliver it to the fluid recovery tank 180 and which is described in more detail hereinafter. As best understood by references to FIGS. 1 and 2, the fluid recovery tank 180 is operable to receive the fluid which has been previously applied to the flooring surface 11 and hold the fluid for an appropriate amount of time before it can be later disposed of in an appropriate manner. The fluid recovery tank has a first or forward facing surface 181 which defines, in part, a portion 182 of the upwardly facing cavity 161, and which holds, at least in part, the hose reel 171. Still further, the forward facing surface defines a first cavity 183. Referring now to FIG. 2, a quick disconnect coupling 184 is provided, and which is received in the first cavity and which is coupled in fluid flowing relation relative to fluid conduit 177. As seen in FIG. 2, a tile or hard floor cleaning assembly 185 is provided, and which receives the first fluid steam under pressure and which is provided by the first electrically actuated pump 120 and delivers it to the hard floor cleaning assembly 185.

Referring now to FIG. 4, it will be seen that the fluid recovery tank 180 has a rearwardly facing surface 190. The rearwardly facing surface further includes a fluid drain 191. A fluid dumping hose 192 is coupled thereto, as illustrated. In this arrangement as seen, the dumping pump 53 may be selectively energized, as will be described hereinafter, to automatically drain the fluid recovery tank once a certain volume of fluid has been received therein. This permits the present invention 10 to run substantially continuously assuming it is provided with a continuous source of water which is provided to the fluid dispensing tank 150, and is further coupled in fluid flowing relation relative to a suitable dumping location. The fluid recovery tank 180 further has first and second sidewalls 193 and 194 which are joined to a bottom surface (not shown). As should be understood, the fluid recovery tank 180 is affixed or otherwise mounted to the fluid dispensing tank 150.

The fluid recovery tank 180 includes a top surface 200 which is joined to the first and second sidewalls 193 and 194 and the forward and rearward facing surfaces 181 and 190, respectively. The top surface 200 defines a rearwardly disposed aperture 201 which defines, in part, a handle which can be used by the operator 14 for pushing or otherwise directing the invention 10 across the flooring surface 11. As seen in the drawings, a pair of resilient tabs are formed into the top surface 202 and define a gap 203 therebetween. The gap is operable to receive a portion of the applicator device 174 as shown, such that the applicator device may be positioned and held in a secure stored location while the assembly 10 is moved from location to location. Additionally, a substantially centrally disposed aperture 204 is formed in the top surface 200. This aperture permits the delivery of various chemicals into the fluid recovery tank 80. As seen by reference to FIG. 6A, the fluid recovery tank includes a cavity 205 which is operable to receive a number of assemblies including a float assembly 210 which is utilized to actuate the dumping pump 53 when the dumping pump is operating in an automatic mode as will be described below. The float assembly 210 is secured in the cavity 205 by means of a mounting bracket 211. Still further, and as seen, a gasket 212 is positioned about the aperture 204, and a substantially circumscribing rigid sealing ring 213 is provided. The sealing ring is operable to matingly cooperate with a lid 214 which substantially occludes the aperture 204. The lid, of course, can be removed so that various cleaning chemicals or other additives may be supplied to the fluid recovery tank 180. As illustrated, the present device 10 also includes a chemical container basket 215 which sits on, or otherwise cooperates with, the circumscribing ring or seal 213 and which holds a container of chemicals 216. A conduit 217 couples the container of chemicals 216 in fluid flowing relation relative to the fluid dispensing tank 150 by means of the fluid coupling 184. As should be understood, the fluid recovery tank 180 is coupled in fluid flowing relation relative to the electrically actuated vacuum pump 110. When energized, the electrically actuated vacuum pump creates a vacuum which is supplied to the fluid recovery tank 180. The fluid recovery tank further has a vacuum hose coupling 220 which extends outwardly through the top surface 200. The vacuum hose coupling 220 is operable to mate in fluid flowing relation relative to the hose 172 which is carried on the hose reel 171. As seen in FIG. 6A, the device 10 includes an auto-fill/float assembly 218 which is operable to meter a source of outside water into the fluid dispensing tank 180.

As further seen by reference to FIG. 6A, an aperture 221 is formed in the top surface 200 of the fluid recovery tank and is operable to receive a series of electronic controls which are generally indicated by the numeral 230, and which are best illustrated by reference to FIG. 5. As seen in that view, the electronic controls 230 include a circuit locator indicator or light 231, which is electrically coupled with the dual electrical cord sensor 104, as earlier described. The present apparatus 10, as earlier discussed, is operable to be supplied with two sources of electrical power by way of two electrical cords which will be described below. The circuit locator indicator will light up to demonstrate whether one or both of the electrical cords, as will be discussed below, are currently providing electrical power to the apparatus 10. As will be seen, the electrical controls 230 also include a first electrically actuated pump/heat selector switch 232. The selector switch 232 has a first position 233 which causes the first electrically actuated pump 120 to be energized, and deliver a first fluid stream having a fluid pressure of about 150 PSI to less than about 1,200 PSI to the flooring surface 11. Further, the same switch 232 has a second position 234 which provides a means for energizing the electrically actuated heater 82. This switch is placed in this second position when the second electrically actuated pump 140 has been selected, as will be described below. Still further, the electronic controls 230 include an on/off switch for energizing the electrically actuated vacuum pump 110. When the electrically actuated vacuum pump 110 is energized, a vacuum is created within the fluid recovery tank and which is operable to draw fluid which has been previously deposited on the flooring surface 11 upwards off of the floor and into the fluid recovery tank 180 where it can later be disposed of by the dumping hose 192. The electronic controls 230 further include an on/off switch 236 to energize the dumping pump 53. As earlier described, the dumping pump is operable to remove the contents of the fluid recovery tank 180 so it may be disposed of through the dumping hose 192. The controls 230 further include an electrical switch 237 which is used to selectively energize the second fluid pump 140 and which is operable to deliver a fluid stream having a fluid pressure of less than about 150 PSI.

As seen most clearly by to FIGS. 1 and 2, the present apparatus 10 is energized by means of a first electrical cord 241, and a second electrical cord 242. In the arrangement as seen, the first electrical cord 241 is operable to energize the invention 10 from a first source of electrical power (not shown), the first electrically actuated fluid pump 120, or in the alternative, to the heater 82. In each case, the first electrically actuated fluid pump and the heater 82 individually consume less than about 15 Amps of electrical power. In the alternative, a second power cord 242 is provided and which is coupled to the second electrically actuated fluid pump 140; the dumping pump 53; and the vacuum pump 110. In this particular case, the electrical power consumed by the second electrically actuated fluid pump, dumping pump and vacuum pump in combination is typically less than about 15 Amps. As earlier discussed, an operator may select by means of the controls 230 to utilize the heater 82 in combination with the second electrically actuated pump 140. This will permit the operator to deliver heated water from the fluid dispensing tank 180 onto the flooring surface 11 to be cleaned. The first and second electrical cords 241 and 242 are electrically coupled to the apparatus 10 by way of the two power cord receptacles 52 as provided rearwardly on the apparatus 10.

OPERATION

The operation of the described embodiment of the present invention is believed to be readily apparent and is briefly summarized at this point.

In its broadest aspect, a cleaning apparatus 10 of the present invention includes a housing 20 which is moveable across a supporting surface 11. Further, the cleaning apparatus 10 includes a first electrically actuated fluid pump 120 which is mounted in the housing 20, and which is operable to deliver a first stream of fluid at a pressure of at least about 150 PSI to less than about 1200 PSI. Still further, the cleaning apparatus 10 includes a second electrically actuated fluid pump 140 which is mounted in the housing 20, and which is operable to deliver a second stream of fluid, at a pressure, of less than about 150 PSI. Further, the cleaning apparatus 10 includes an electrically actuated heater 82 which is mounted in the housing, and which is operable to impart heat energy to the second fluid stream. In the arrangement as seen, the first and second electrically actuated fluid pumps 120 and 140 are not energized substantially simultaneously. Still further, in the arrangement as shown, the electrically actuated heater may be rendered inoperable by means of the electronic controls 230. In the arrangement as shown, the first electrically actuated pump 120, when energized, consumes less than about 15 Amps of electrical power and further, the second electrically actuated pump 140 and the heater 82, when energized together, collectively consume less than about 15 Amps of electrical power. In the arrangement as seen, the first electrically actuated pump 120 and the heater 82 are alternatively energized from a first AC power source. Still further, the second electrically actuated pump is energized from a second AC power source.

The cleaning apparatus 10 of the present invention includes a base portion 21 which is moveably supported in spaced relation relative to an underlying floor 11 by a plurality of wheels 31 and 32, and wherein the base portion has a first and second end 24 and 25, and an upwardly facing surface 80. The cleaning apparatus 10 further includes an upper housing portion 22 having a main body which is hingedly mounted to the first end of the base portion. The upper housing portion matingly couples with and rests in covering relation relative to the upwardly facing surface of the base portion 21. The upper housing portion defines, in part, an internal cavity 170. The cleaning apparatus 10 includes a fluid dispensing tank 150 which forms a portion of the upper housing portion 22, and which is further disposed in spaced relation relative to the upwardly facing surface 80 of the base portion. The cleaning apparatus 10 further includes a fluid recovery tank 180 which forms a portion of the upper housing portion, and which is positioned in spaced relation relative to the upwardly facing surface 80 of the base portion, and is juxtaposed relative to the fluid dispensing tank 150. A hose reel 171 is rotatably supported, at least in part, on the fluid dispensing tank 150. Further, an electrically actuated dumping pump 53 is mounted on the first end 24 of the base portion 21, and which is coupled in fluid flowing relation relative to the fluid recovery tank 180. The dumping pump 53 is operable, when energized, to remove fluid from the fluid recovery tank 180 and expel it to the ambient environment. In the arrangement as shown, the cleaning apparatus 10 includes an electrically actuated vacuum pump 110 which is borne by the upwardly facing surface 80 of the base portion 21, and received, at least in part, in the cavity 170 which is defined by the upper housing portion 22. The electrically actuated vacuum pump is further coupled in fluid flowing relation relative to the fluid recovery tank 180. The electrically actuated vacuum pump, when energized, is operable to remove fluid which is present on the flooring surface 11, and deliver it into the fluid recovery tank 180. A first electrically actuated fluid pump 120 is borne by the upwardly facing surface 80 of the base portion 21, and is coupled in fluid flowing relation relative to the fluid dispensing tank 180. The first electrically actuated fluid pump, when energized, removes a source of fluid from the fluid dispensing tank 150. The first electrically actuated fluid pump creates a first stream of fluid which is delivered to the flooring surface 11 at a pressure of at least about 150 PSI to less than about 1200 PSI. The apparatus 10 further includes a first power cord 241 which is electrically coupled to the first electrically actuated fluid pump 120 and which is operable to deliver a source of electrical power to the first electrically actuated fluid pump. The first electrically actuated fluid pump 120 consumes less than about 15 Amps of electricity from the first source of electrical power. A second electrically actuated fluid pump 140 is provided and which is borne by the upwardly facing surface 80 of the base portion 21. This second pump is coupled in fluid flowing relation relative to the fluid dispensing tank 150. The second electrically actuated fluid pump 140, when energized, removes the source of fluid from the fluid dispensing tank 150, and further creates a second stream of fluid which is delivered to the flooring surface 11 at a pressure of less than about 150 PSI. An electrically actuated heater 82 is provided and which is operable to impart heat energy to the second fluid stream. The second electrically actuated heater is mounted on the upwardly facing surface 80 of the base portion 21, and is further energized by way of the first power cord 241. The electrically actuated heater 82 consumes less than about 15 Amps of electrical power from the first source of electrical power. Further, the first electrically actuated fluid pump and the electrically actuated heater are alternatively energized by means of the electronic controls 230. Still further, the present invention includes a second power cord 242 which is electrically coupled to the second electrically actuated fluid pump 140, dumping pump 53 and vacuum pump 110. The electrical power consumed by the second electrically actuated fluid pump, dumping pump and vacuum pump, in combination, is less than about 15 Amps. The present invention further includes a foot operated priming assembly 60 which is borne by the base portion 21, and which is operably coupled with the electrically actuated vacuum pump 110. In the arrangement as seen, the foot operated priming assembly in combination with the vacuum pump 110 facilitates the priming of the first electrically actuated fluid pump 120.

Therefore, it will be seen that the present cleaning apparatus 10 provides many advantages over the various prior art devices which have been utilized heretofore and provides both first and second fluid streams which are utilized for given cleaning purposes. As discussed above, the first fluid stream is provided by the first electrically actuated pump 120. This fluid stream having a pressure of greater than about 150 PSI to less than about 1200 PSI is greatly effective in cleaning hard surfaces such as grouted tile and the like 13. Still further, the present apparatus can be quickly converted to use on a carpeted surface 12. Moreover, the effectiveness of such device on a carpeted surface is greatly enhanced by the use of a heated water or fluid stream. Consequently, an electrically actuated heater 82 is provided and can be used to heat the fluid being delivered by the second electrically actuated fluid pump 140.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A cleaning apparatus, comprising:

a housing which is moveable across a supporting surface;

a first electrically actuated fluid pump which is mounted in the housing, and which is operable to deliver a first stream of fluid at a pressure of at least about 150 PSI to less than about 1200 PSI;

a second electrically actuated fluid pump, discrete and different from the first electrically actuated pump, which is mounted in the housing, and which is operable to deliver a second stream of fluid, at a pressure, of less than about 150 PSI;

an electrically actuated heater which is mounted in the housing, and which is operable to impart heat energy to the second fluid stream;

an electrically actuated vacuum pump which is mounted in the housing;

wherein the first and second electrically actuated pumps, when individually energized, are operable to deliver the first and second streams of fluid onto a surface to be cleaned and wherein the electrically actuated vacuum pump is operable to recover the fluid which has been previously deposited onto the surface to be cleaned; and wherein the first electrically actuated pump is energized from a first AC power source and the second electrically actuated pump is energized from a second AC power source discrete and different from the first AC power source.

2. A cleaning apparatus as claimed in claim 1, and wherein the first and second electrically actuated pumps are not energized substantially simultaneously.

3. A cleaning apparatus as claimed in claim 1, and wherein the electrically actuated heater may be rendered inoperable.

4. A cleaning apparatus as claimed in claim 1, and wherein the first electrically actuated pump, when energized, consumes less than about 15 Amps of electrical power.

5. A cleaning apparatus as claimed in claim 1, and wherein the second electrically actuated pump and the heater, when energized together, collectively consume more than about 15 Amps of electrical power.

6. A cleaning apparatus as claimed in claim 5, and wherein the first electrically actuated pump and the heater are alternatively energized from the first AC power source.

7. A cleaning apparatus as claimed in claim 1, and further comprising:

a fluid dispensing tank which is defined, at least in part, by the housing and which encloses a source of fluid which is withdrawn from the fluid dispensing tank by the respective first and second electrically actuated pumps to form the first and second streams of fluid;

a fluid recovery tank which is defined, at least in part, by the housing; and wherein the electrically actuated vacuum pump is coupled in fluid flowing relation relative to the fluid recovery tank.

8. A cleaning apparatus as claimed in claim 7, and further comprising:

an electrically actuated dumping pump borne by the housing, and coupled in fluid flowing relation relative to the fluid recovery tank, and wherein the dumping pump is operable to withdraw fluid which has been previously delivered into the fluid recovery tank by the electrically actuated vacuum pump, and deliver it to a remote location.

9. A cleaning apparatus as claimed in claim 1, and wherein the housing further comprises:

a base portion which is supported in spaced, rolling relation relative to the supporting surface, and which defines an upwardly facing equipment supporting surface; and an upper portion which is hingedly mounted on the bottom portion, and which defines an internal cavity, and wherein the upper portion releasably mates with the base portion, and is disposed in covering relation relative to the upwardly facing equipment supporting surface.

10. A cleaning apparatus as claimed in claim 9, and wherein each of the first and second fluid actuated pumps are mounted on the upwardly facing supporting surface of the base portion, and are received in the internal cavity as defined by the upper portion when the upper portion is disposed in mating, substantially covering relation relative to the base portion.

11. A cleaning apparatus as claimed in claim 10, and wherein the upper portion of the housing further comprises:

a fluid dispensing tank which is coupled in fluid flowing relation relative to the respective first and second electrically actuated fluid pumps;

the electrically actuated vacuum pump which is mounted on the upwardly facing equipment supporting surface of the base portion; and a fluid recovery tank which is borne by the upper portion, and which is coupled in fluid flowing relation relative to the electrically actuated vacuum pump.

12. A cleaning apparatus as claimed in claim 11, and further comprising:

an electrically actuated dumping pump which is mounted on the base portion, and coupled in fluid flowing relation relative to the fluid recovery tank.

13. A cleaning apparatus as claimed in claim 12, and further comprising:

a foot operated priming assembly which is borne by the base portion, and which is operably coupled with the electrically actuated vacuum pump, and wherein the foot operated priming assembly operating in combination with the vacuum pump facilitates the priming of the first electrically actuated fluid pump.

14. A cleaning apparatus as claimed in claim 11, and wherein the upper portion of the housing has an outwardly and upwardly facing surface, and wherein an aperture is formed in the outwardly, and upwardly facing surface of the upper portion, and which allows fluid flowing access to the fluid dispensing tank.

15. A cleaning apparatus as claimed in claim 14, and wherein the outwardly and upwardly facing surface of the upper portion defines a cavity which receives and supports a hose reel.

16. A cleaning apparatus, comprising:

a moveable base portion having an upwardly facing, and a downwardly facing surface;

a first electrically actuated fluid pump which consumes less than about 15 AMPS of electrical power, and which, when energized, is operable to deliver a first fluid stream at a pressure of at least 150 PSI to about 1200 PSI, and wherein the first electrically actuated pump is mounted on the upwardly facing surface of the base portion;

a second electrically actuated fluid pump, discrete and different from the first electrically actuated pump, which consumes a given amount of electrical power, and which, when energized, is operable to deliver a second fluid stream at a pressure of less than about 150 PSI, and wherein the second electrically actuated fluid pump is mounted on the upwardly facing surface of the base portion;

an electrically actuated heater mounted on the upwardly facing surface of the base portion, and which is coupled in fluid flowing relation relative to the second electrically actuated fluid pump, and wherein the electrically actuated heater consumes a given amount of electrical power, and wherein the electrical power consumed by the electrically actuated heater is less than about 15 AMPS;

an electrically actuated vacuum pump mounted on the upwardly facing surface of the base portion;

a first source of AC electrical power and which is alternatively electrically coupled to the first electrically actuated fluid pump, and the electrically actuated heater;

a second source of AC electrical power, discrete and different from the first source of AC electrical power, and which is electrically coupled to the second electrically actuated fluid pump and the vacuum pump; and a fluid dispensing tank positioned in spaced relation relative to the base portion, and which is further coupled in fluid flowing relation relative to each of the first and second electrically actuated fluid pumps, and the heater.

17. A cleaning apparatus as claimed in claim 16, and further comprising:

an upper housing portion which releasably matingly couples with the base portion, and which is further disposed in covering relation relative to the upwardly facing surface of the base portion, and wherein the fluid dispensing tank is made integral with the upper housing portion, and is positioned in spaced relation relative to the upwardly facing surface of the base portion.

18. A cleaning apparatus as claimed in claim 17, and further comprising:

a fluid recovery tank which is made integral with the upper housing portion, and which is further positioned in spaced relation relative to the upwardly facing surface of base portion, and wherein the fluid recovery tank is coupled in fluid flowing relation relative to the electrically actuated vacuum pump.

19. A cleaning apparatus as claimed in claim 17, and wherein each of the fluid dispensing and fluid recovery tanks have an upwardly facing surface, and wherein an aperture is defined in the upwardly facing surface of the fluid dispensing tank and which facilitates fluid flowing access to the fluid dispensing tank, and wherein the upwardly facing surface of the fluid recovery tank further defines an upwardly facing cavity which supports a hose reel.

20. A cleaning apparatus as claimed in claim 19, and wherein the hose reel is supported for rotational movement relative to the cavity which is defined by the upwardly facing surface of the fluid dispensing tank.

21. A cleaning apparatus as claimed in claim 16, and wherein the heater, and the second electrically actuated fluid pump are individually, selectively energized.

22. A cleaning apparatus as claimed in claim 16, and further comprising:

an electrically actuated dumping pump borne by the base portion, and which is coupled in fluid flowing relation relative to the fluid recovery tank, and which is further energized by the second source of AC electrical power; and a foot operated priming assembly operably coupled with the first electrically actuated fluid pump, and the electrically actuated vacuum pump, and which facilitates the priming of the first electrically actuated fluid by energizing the vacuum pump to cause the vacuum pump to expel air which is present within the first electrically actuated fluid pump, and draw a source of fluid contained within the fluid dispensing tank through the first electrically actuated fluid pump to facilitate the priming of the first electrically actuated fluid pump.

23. A cleaning apparatus, comprising:

a base portion which is moveably supported in spaced relation relative to an underlying floor by a plurality of wheels, and wherein the base portion has a first and second end, and an upwardly facing surface;

an upper housing portion having a main body which is hingedly mounted to the first end of the base portion, and wherein the upper housing portion matingly couples with and rests in covering relation relative to the upwardly facing surface of the base portion, and wherein the upper housing portion defines an internal cavity;

a fluid dispensing tank which forms a portion of the upper housing portion, and which is further disposed in spaced relation relative to the upwardly facing surface of the base portion;

a fluid recovery tank which forms a portion of the upper housing portion, and which is positioned in spaced relation relative to the upwardly facing surface of the base portion, and is juxtaposed relative to the fluid dispensing tank;

a hose reel which is rotatably supported on the fluid dispensing tank;

an electrically actuated dumping pump mounted on the first end of the base portion, and which is coupled in fluid flowing relation relative to the fluid recovery tank, and wherein the dumping pump is operable, when energized, to remove fluid from the fluid recovery tank and expel it to the ambient environment;

an electrically actuated vacuum pump borne by the upwardly facing surface of the base portion, and received in the cavity which is defined by the upper housing portion, and wherein the electrically actuated vacuum pump is further coupled in fluid flowing relation relative to the fluid recovery tank, and wherein the electrically actuated vacuum pump, when energized, is operable to remove fluid which is present on the floor, and deliver it into the fluid recovery tank;

a first electrically actuated fluid pump which is borne by the upwardly facing surface of the base portion, and which is coupled in fluid flowing relation relative to the fluid dispensing tank, and wherein the first electrically actuated fluid pump, when energized, removes a source of fluid from the fluid dispensing tank and creates a first stream of fluid which is delivered to the floor at a pressure of at least about 150 PSI to less than about 1200 PSI;

a first power cord which is electrically coupled to the first electrically actuated fluid pump and which is operable to deliver a first source of electrical power to the first electrically actuated fluid pump, and wherein the first electrically actuated fluid pump consumes less than about 15 Amps of electricity from the first source of electrical power;

a second electrically actuated fluid pump, discrete and different from the first electrically actuated fluid pump, which is borne by the upwardly facing surface of the base portion, and which is coupled in fluid flowing relation relative to the fluid dispensing tank, and wherein the second electrically actuated fluid pump, when energized, removes the source of fluid from the fluid dispensing tank, and further creates a second stream of fluid which is delivered to the floor at a pressure of less than about 150 PSI;

an electrically actuated heater which is operable to impart heat energy to the second fluid stream, and which is mounted on the upwardly facing surface of the base portion, and which is further energized by way of the first power cord, and wherein the heater consumes less than about 15 Amps of electrical power from the first source of electrical power, and wherein the first electrically actuated fluid pump and the electrically actuated heater are alternatively energized; and a second power cord, discrete and different from the first power cord, which is electrically coupled to the second electrically actuated fluid pump, dumping pump; and vacuum pump, and wherein the electrical power consumed by the second electrically actuated fluid pump, dumping pump and vacuum pump, in combination, is less than about 15 Amps.

24. A cleaning apparatus comprising:

a housing which is moveable across a supporting surface;

a first electrically actuated fluid pump which is mounted in the housing, and which is operable to deliver a first stream of fluid at a first pressure;

a second electrically actuated fluid pump, discrete and different from the first electrically actuated fluid pump, which is mounted in the housing, and which is operable to deliver a second stream of fluid at a second pressure which is different than the first pressure;

an electrically actuated heater which is mounted in the housing and which is operable to impart heat energy to the second fluid streams;

an electrically actuated vacuum pump which is mounted in the housing;

wherein the first and second electrically actuated pumps, when individually energized, are operable to deliver the first and second streams of fluid onto a surface to be cleaned and wherein the electrically actuated vacuum pump is operable to recover the fluid which has been previously deposited onto the surface to be cleaned; and wherein the first electrically actuated pump is energized from a first AC power source and the second electrically actuated pump is energized from a second AC power source discrete and different from the first AC power source.

25. A cleaning apparatus as claimed in claim 24, and wherein the first fluid pressure is about 150 PSI to about 1200 PSI.

26. A cleaning apparatus as claimed in claim 25, and wherein the second fluid pressure is less than about 150 PSI.

27. A cleaning apparatus as claimed in claim 24, and wherein the first and second electrically actuated pumps are not energized substantially simultaneously.

28. A cleaning apparatus as claimed in claim 27, and wherein first electrically actuated pump, when energized, consumes less than about 15 amps of electrical power.

29. A cleaning apparatus as claimed in claim 24, and wherein the first and second electrically actuated pumps are energized substantially simultaneously, and wherein the respective electrically actuated pumps each consume less than about 15 Amps of electrical power from the first and second AC power sources.

30. A cleaning apparatus as claimed in claim 24, and wherein the first electrically actuated fluid pump and the heater are alternatively energized from the first AC power source.

31. A cleaning apparatus as claimed in claim 24, and wherein the second electrically actuated fluid pump and the heater are alternatively energized from the second AC power source.

32. A cleaning apparatus as claimed in claim 24, and wherein the first fluid stream comprises, at least in part, an unheated water stream which is directed against a first surface to be cleaned, and the second fluid stream comprises, at least in part, a heated water stream which is directed against a second surface to be cleaned.

33. A cleaning apparatus as claimed in claim 32, and wherein the first surface to be cleaned is a hard flooring surface, and the second surface to be cleaned comprises a carpeted flooring surface.

* * * * *

UNITED STATES PATENT AND TRADEMARK OFFICE

CERTIFICATE OF CORRECTION

PATENT NO. : 7,627,926 B2
APPLICATION NO. : 11/130473
DATED : December 8, 2009
INVENTOR(S) : Steve Williams It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1240 days.

Signed and Sealed this

Second Day of November, 2010

David J. Kappos

David J. Kappos
*Director of the United States Patent and Trademark Office*